US006369307B1

(12) United States Patent
Wells

(10) Patent No.: US 6,369,307 B1
(45) Date of Patent: Apr. 9, 2002

(54) DEVICE FOR FORMING CHORDS

(76) Inventor: Colin Wells, Avalon House, 1 Launcelot Street, Lower Marsh, Waterloo, London SE1 7AD (GB)

( * ) Notice: Subject to any disclaimer, the term of this patent is extended or adjusted under 35 U.S.C. 154(b) by 0 days.

(21) Appl. No.: 09/530,299

(22) PCT Filed: Oct. 29, 1998

(86) PCT No.: PCT/GB98/03237

§ 371 Date: Apr. 27, 2000

§ 102(e) Date: Apr. 27, 2000

(87) PCT Pub. No.: WO99/23639

PCT Pub. Date: May 14, 1999

(30) Foreign Application Priority Data

Nov. 1, 1997 (GB) ..... 9723039
Jun. 25, 1998 (GB) ..... 9813601

(51) Int. Cl.[7] ..... G10D 3/00
(52) U.S. Cl. ..... 84/319
(58) Field of Search ..... 84/319, 315, 316, 84/317, 318, 320, 322

(56) References Cited

U.S. PATENT DOCUMENTS

| | | | | | |
|---|---|---|---|---|---|
| 3,386,325 | A | * | 6/1968 | Smith | 84/319 |
| 3,822,629 | A | * | 7/1974 | Smith | 84/319 |
| 3,854,368 | A | * | 12/1974 | Pogan | 84/319 |
| 4,248,128 | A | * | 2/1981 | Des Gaines | 84/322 |
| 4,790,227 | A | * | 12/1988 | Lukehart | 84/322 |
| 5,594,189 | A | * | 1/1997 | Latteri | 84/322 |
| 5,981,856 | A | * | 11/1999 | Story | 84/319 |
| 6,133,516 | A | * | 10/2000 | Hendrickson | 84/322 |

* cited by examiner

*Primary Examiner*—Robert E. Nappi
*Assistant Examiner*—Kim Lockett
(74) *Attorney, Agent, or Firm*—Jackson Walker L.L.P.

(57) ABSTRACT

A device for forming chords on stringed instruments which have a fingerboard. A bar presses a plurality of strings on the fingerboard at a chosen position, a second member projects forward of the first bar and presses at least one string ahead of the first bar when the device is rotated about the first bar, a third member projects rearwardly and presses at least one string behind the first bar when the device is rotated in the opposite direction. There is at least one groove rearwardly of the first bar which, when the bar is rotated, a respective string is released from the bar.

16 Claims, 8 Drawing Sheets

(major 2nd inversion)

E A C♯ E A C♯

(major 1st inversion)

E♯ G♯ C♯ E♯ G♯ C♯

(major root)

F A C F A C (full bar position - these chords are all augmented Vth chords)

F A C♯ F A C♯

F A C♯ F A C♯

F A C♯ F A C♯

(minor root)

F♯ A C♯ F♯ A C♯

(minor 2nd inversion)

E♯ A♯ C♯ E♯ A♯ C♯

(minor 1st inversion)

F A D F A D (augmented Vth chord)

F♭ A♭ C F♭ A♭ C (major IXth chord)

F G C F G C (diminished Vth chord)

F A♭ C♭ F A♭ C♭

(full bar position - these chords are all minor root position chords)

F A♭ C F A♭ C

F A♭ C F A♭ C

F A♭ C F A♭ C (dominant VIIth chord 3rd inversion)

G♭ A♭ C G♭ A♭ C (major root position)

F A C F A C (major 1st inversion which is the resolution of the Dom VIIth at 8g)

F A♭ D♭ F A♭ D♭

(major 1st inversion & dominant chord of both 9c and 9d)

E C E G C E (dominant VIIth chord 3rd inversion of the major chord at 9a)

F B F G B F (minor root)

F C F Ab C F (major root)

F C F A C F (major root)

F C E G♯ B E (major 1st inversion)

F C F Ab Db F

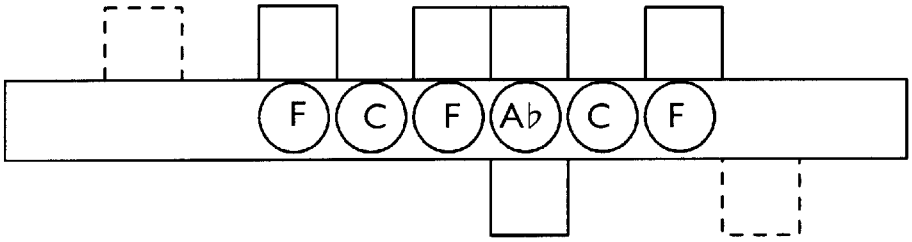
Fig 10
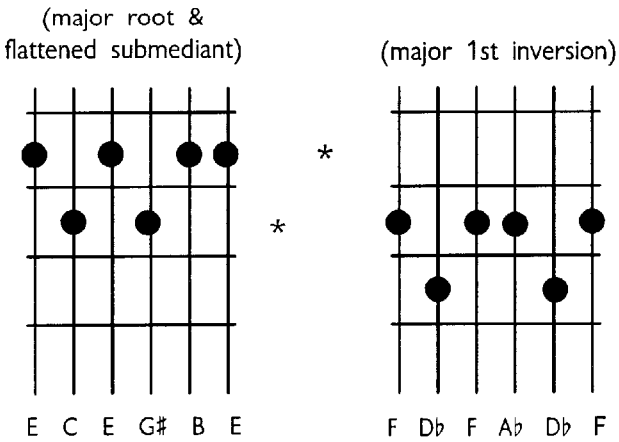
Fig 11(a) Fig 11(b)
Fig 12
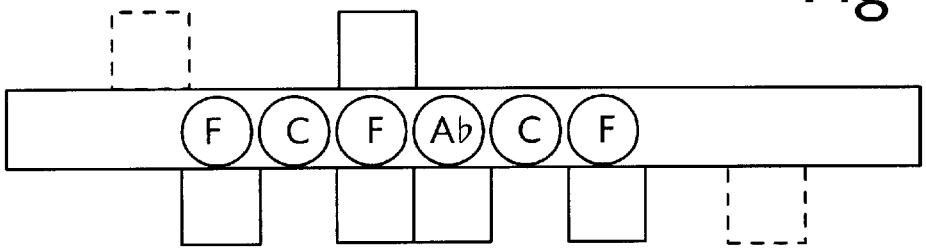
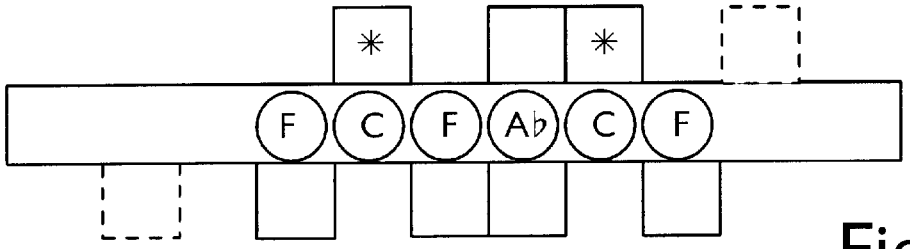
Fig 13

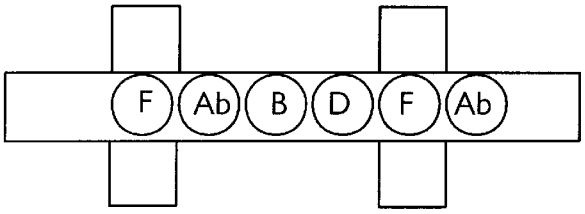

Fig 14

(dominant VIIth 1st inversion)

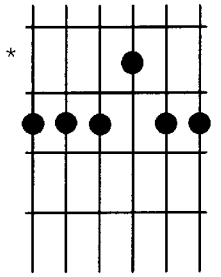

F Ab B Db F Ab

Fig 15(a)

(dominant VIIth root position)

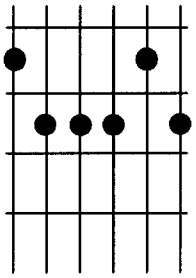

E G# B D E G#

Fig 15(b)

(dominant VIIth 3rd inversion)

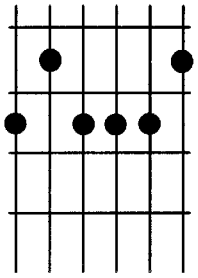

F G B D F G

Fig 15(c)

(dominant VIIth 2nd inversion)

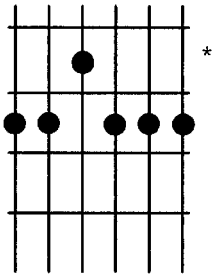

F Ab Bb D F Ab

Fig 15(d)

(full bar position - all four chords are diminished VIIth chords on F)

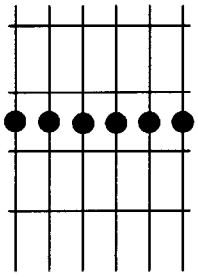

F Ab B D F Ab

Fig 15(e)

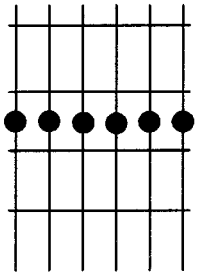

F Ab B D F Ab

Fig 15(f)

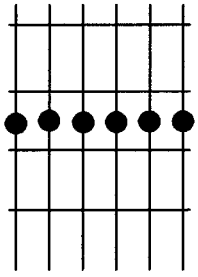

F Ab B D F Ab

Fig 15(g)

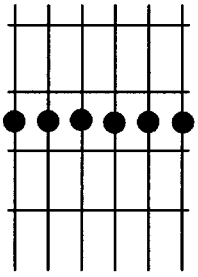

F Ab B D F Ab

Fig 15(h)

(minor with added 6th 3rd inversion)

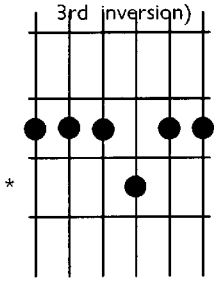

F Ab B Eb F Ab

Fig 15(i)

(minor with added 6th 2nd inversion)

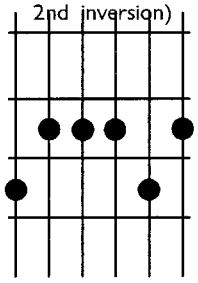

Gb Ab B D Gb Ab

Fig 15(j)

(minor with added 6th 1st inversion)

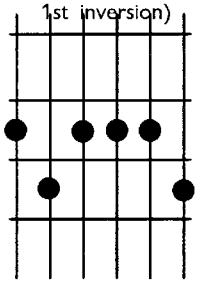

F A B D F A

Fig 15(k)

(minor with added 6th root position)

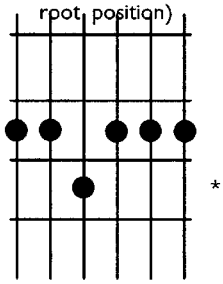

F Ab C D F Ab

Fig 15(l)

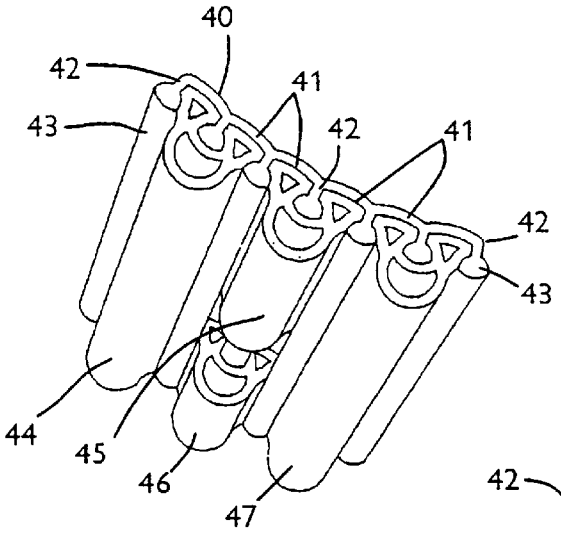
Fig 17
Fig 18
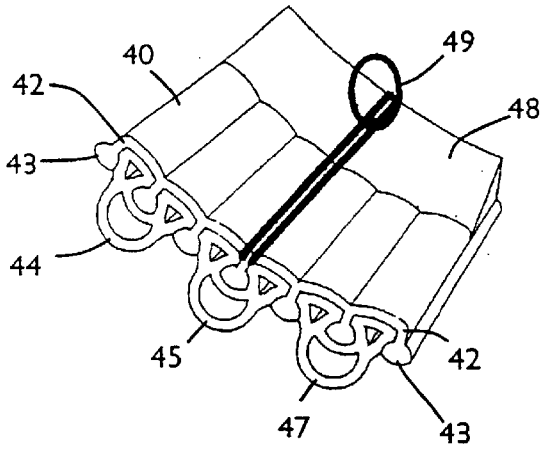
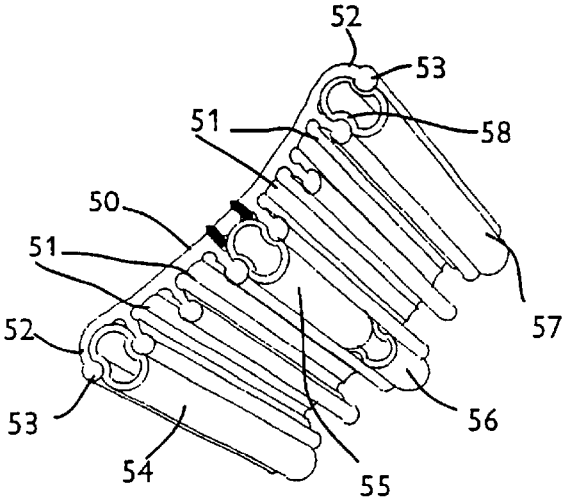
Fig 19
Fig 20
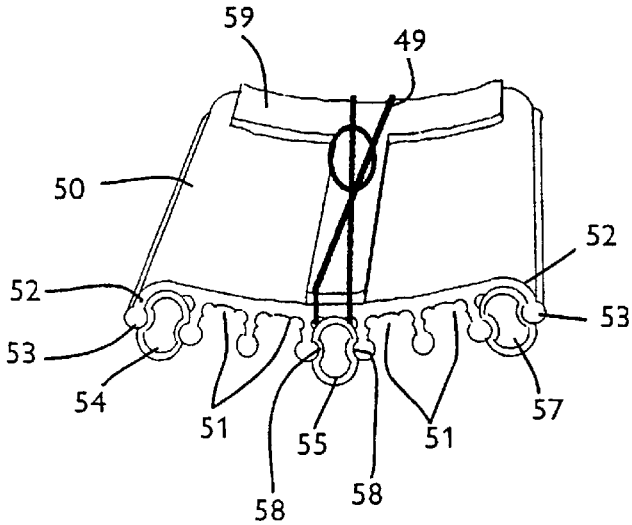

DEVICE FOR FORMING CHORDS

FIELD OF THE INVENTION

This invention relates to a device for forming chords on a stringed musical instrument of the type having a fingerboard.

BACKGROUND OF THE INVENTION

The formation of chords by pressing selected strings against the fingerboard at selected positions while plucking, strumming or even bowing the strings is a skill requiring strength and dexterity, and a great deal of dedicated practice to acquire. In addition, the fingertips which press the strings have to harden before the instrument can be played for any length of time without discomfort. These factors are sufficient to discourage many from even starting to learn.

Various proposals have been made to assist to replace the fingering action. For example, U.S. Pat. No. 3,922,945 (Pettijohn) discloses a hand-held chord fingering device comprising an especially shaped, rigid and generally palm sized body having oblong fingering pads in a pre-determined pattern, the pads being spaced apart along the fingerboard, and the rearmost being a complete bar of all the strings. By sliding the device laterally across the strings, different chords can be formed. Considerable skill is still required to use the device; subtle variations in the position of the device can produce very different chords. Another example of such a device is disclosed in U.S. Pat. No. 4,471,682 (Bozung), which provides adjustable string depresser bars. Again, the use of the device requires skill, and setting up the adjustable depresser bars is probably beyond the ability of a novice player. DE 42 33 041 discloses a bottleneck device for use when playing the guitar. It comprises a tube into which a finger can be inserted, and a channel member mounted ahead of the tube and on to which another finger can be pressed to rotate the channel member into contact with one or more strings to give the sliding tone effect of the bottle neck. It does not provide an alternative way of forming chords, but is for use by experienced guitarists.

The present invention provides a device which is simple to use, while providing a wide range of chords.

SUMMARY OF THE INVENTION

According to the invention, there is provided a device for forming chords on stringed musical instruments of the type having a fingerboard, the device comprising first means for pressing a plurality of strings on to the fingerboard at a chosen position along the fingerboard, and second means forward of the first means for engaging at least one string, characterised by third means rearward of the first means for pressing at least one string against the fingerboard, whereby the device may be rocked in one direction about said first means such that the second means can raise the pitch of at least one string and in the other direction about the first means such that the third means can engage at least one string so that the pitch of said string is lower relative to the pitch achievable by pressing said string at the chosen position.

Preferably, the device comprises a bar for pressing a plurality of strings on to the fingerboard at the chosen position along the fingerboard, means projecting forward of the bar for pressing at least one string ahead of the bar when the device is rocked about the bar, means projecting rearwardly of the bar, or a further rearmost bar which depresses all the strings behind the bar, for pressing at least one string behind the bar when the device is rocked in the opposite direction about the bar, and at least one groove rearwardly of the bar such that, as the bar is rocked, a respective string is released from the bar.

The device may be arranged to be held in the fingers of one hand of the player of the instrument. In one embodiment, the device has a hollow section into which at least one of the player's fingers may be inserted, to permit the device to be manipulated in the manner of a guitar 'bottle neck'. Such a device may be slightly conical along its length to compensate for the difficulty of the player applying even pressure across the width of the fingerboard. Alternatively, or additionally, it may comprise a flexible resilient material which moulds itself to the finger or fingers inside the tube or on the topmost outer surface of the generator and resumes its original shape when the finger of fingers is or are removed.

The device may be made of any solid material, but is conveniently formed of a plastics material, and this material may be transparent to assist the player in placing the device correctly on the fingerboard. The correct vertical alignment of the device can be indicated by marks on the underside, visible through the transparent body of the device. At least a surface layer of the device may be formed of an elastomeric material to act as a damper, while the components which project forwardly or rearwardly of the bar to depress strings in front of or behind the bar may be provided with gripping faces, for example of the same elastomeric material, to contact the strings and ensure that good contact is made without any tendency of the strings to buzz when plucked, strummed or bowed.

The device may comprise individual contact members mountable in selected positions on a body portion, for example, by sliding the contact members into grooves in the underside of the body portion. The contact members may be formed of resilient plastics material, for example, elastomer, and may be formed with voids therein to increase compressibility, thereby assisting the contact members to press the strings evenly over a curved fingerboard.

While the device of the invention is especially suitable for use with guitars and similar instruments, it may be used with other stringed instruments having a fingerboard, for example the violin family of instruments. The device can be made in a range of different sizes to accommodate different fingerboard widths and to take account of different numbers of strings, and of different shapes to accommodate fingerboards which are not flat across their widths, for example those of the violin family of instruments. The device can be made for use from the top of the fingerboard to the bottom generating the same family of chords at each fret point, without alteration or adjustment, in various transpositions.

Grooves are preferably formed with rounded sides to accommodate sideways movement across the strings. The grooves may be provided by means of press-off or other readily removable components.

The projections forwardly and rearwardly may be formed by slot-in or other readily added components, or by selectively removing integrally-moulded projections to provide the desired combination. The projections may be shaped so as to have a slightly greater diameter towards each end thereof compared with the centre, so as to tend to guide a string towards the centre before pressure is applied, ensuring correct positioning.

To assist the user, tuning pipes may be provided with the device to set the tunings in accordance with the particular configuration of the device. The user may also be provided with stickers to attach to the fingerboard to denote the chords.

Different gauge strings may be used to restring existing instruments to create the optimum sound for each different opening tuning.

A plurality of the devices may be attached together to form a cylinder providing many different chord arrangements in one device.

A strap, a grip or a glove which is attached to the device may be provided to help hold the device evenly on the fingerboard.

A ratchet system may be provided to create grooves when the rearward nodules are pushed into position.

A nodules may be cylindrical in shape, but other shapes may be used, for example semi-cylindrical, with the curved surface downwards or upwards, or flat.

BRIEF DESCRIPTION OF THE DRAWINGS

Reference is made to the drawings, which illustrate exemplary embodiments of the invention, and in which:

FIG. 10 shows a diagrammatic plan view of a modified form of the device shown in FIG. 8;

FIGS. 11*a* and 11*b* are diagrams showing additional chords achievable with the modified device of FIG. 10;

FIGS. 12 and 13 are diagrammatic plan views illustrating alternative modifications to the device of FIG. 8;

FIG. 14 is a diagrammatic plan view of a device having yet another arrangement of projections;

FIGS. 15*a* to 15*l* are diagrams showing chords achievable with the device shown in FIG. 14;

FIG. 17 is a perspective view from below of a further embodiment;

FIG. 18 is a view from above of the embodiment shown in FIG. 17;

FIG. 19 is a perspective view from below of a still further embodiment; and

FIG. 20 is a view from above of the embodiment shown in FIG. 19.

DETAILED DESCRIPTION OF THE ILLUSTRATED EMBODIMENTS

Figure 1:
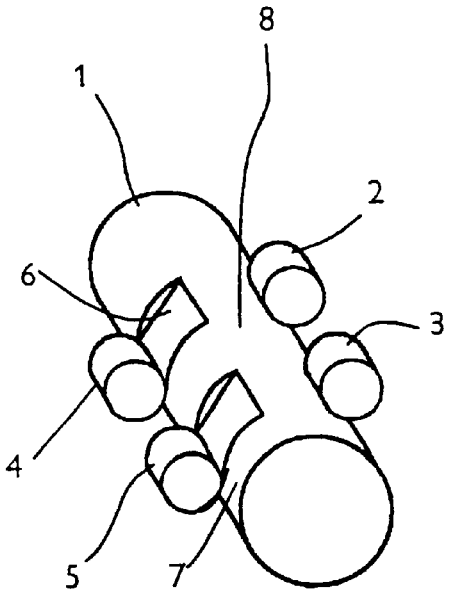
FIGS. 1 and 2 are respectively underneath and top perspective views of a first embodiment.
Figure 2:
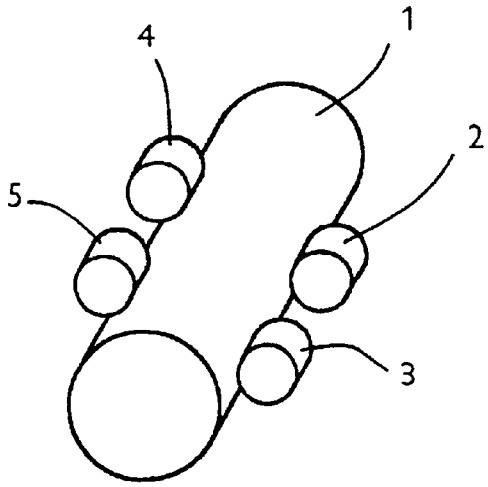

Referring first to FIGS. 1 and 2, the device comprises a main cylindrical body 1 having two forward nodules 2 and 3 attached thereto and two rearward nodules 4 and 5. Cut-outs or slots 6 and 7 are formed in the body 1, aligned with the rearward nodules 4 and 5. As will be seen from FIG. 1, the underside of the device which comes into contact with the guitar strings in use has a region 8 which presses all the strings on to the fingerboard at a particular position (in the case of a guitar, between a particular pair of frets), thus acting as a barre. Rolling the device forward from this position as shown in FIG. 2, depresses two of the strings after the next fret along the fingerboard, raising each string by a semitone. Rolling the device backwards causes the slots 6 and 7 to release two strings (not necessarily the same two strings) from the barre, while the aligned rearward nodules 4 and 5 depress the two strings behind the rear fret of the pair, lowering each string by a semitone (it will be appreciated that the position and shape of any of the nodules, both forward and rearward, may be chosen to depress the strings at a greater distance from the barre, raising of lowering the pitch of the individual string by more than a semitone, if desired). Each of the nodules 2 to 5 is in the form of a short cylinder attached to the body 1. The nodules may be integrally moulded with the body, or attached thereto by glue, screws, or any other fixing means or method.

Figure 3:
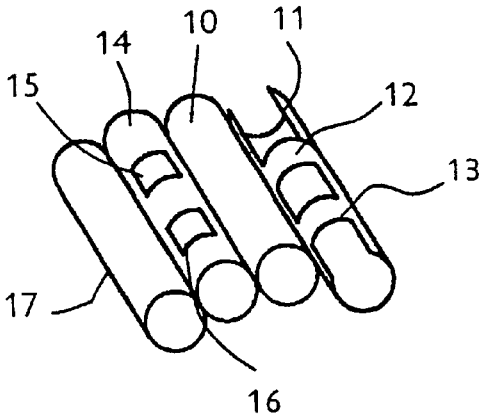
FIGS. 3 and 4 are corresponding perspective views of a second embodiment.
Figure 4:
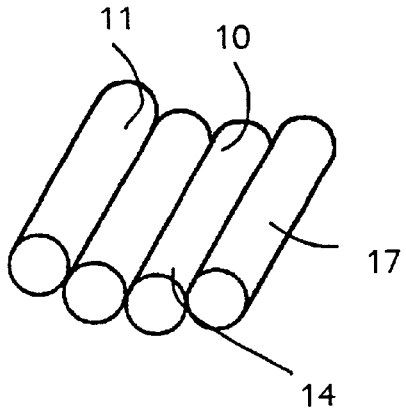

The embodiment of FIGS. 3 and 4 comprises a series of cylinders attached to each other in such a manner as to form a curve in profile, so that one cylinder may be rotated out of contact with the fingerboard and the next rotated into contact with the same movement. The device has a main cylinder 10 which acts as a barre in the chosen position. Forward of this, the next cylinder 11 is partially cut away so that the greater part of the length is semi-cylindrical, with two short cylindrical portions 12 and 13 remaining to act as the nodules of the embodiment of FIGS. 1 and 2. The cylinder 14 attached to the opposite side of the main cylinder 10 has two slots 15 and 16 cut therein so that rotation back on to this cylinder causes only some of the strings to be depressed in the space between the frets, with the strings corresponding to the positions of the slots being depressed beyond the next fret, to lower the pitch by a further semitone, by means of another cylinder 17 behind the slotted cylinder 14, this last forming another barre.

Examples of the configurations possible, and their effects, will now be described with reference to FIGS. 5 to 15.

EXAMPLE 1

Figure 5:
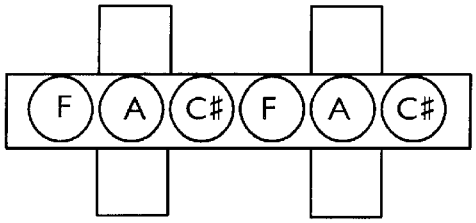
FIG. 5 shows a diagrammatic plan view of a device having a first arrangement of projections.
Figure 6A:
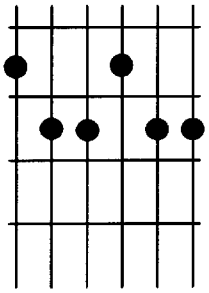
FIGS. 6*a* to 6*i* are diagrams showing chords achievable with the device of FIG. 5 with a first tuning of the guitar.
Figure 6B:
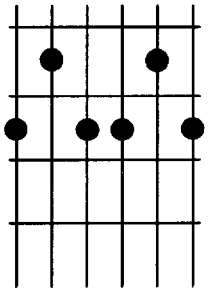
Figure 6C:
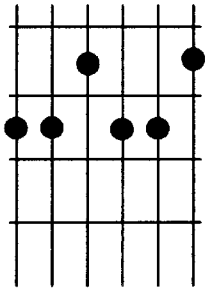
Figure 6D:
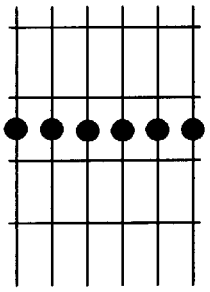
Figure 6E:
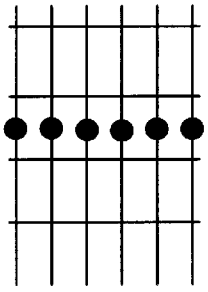
Figure 6F:
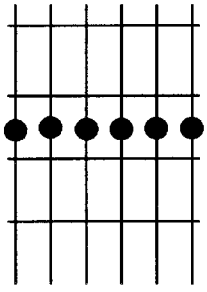
Figure 6G:
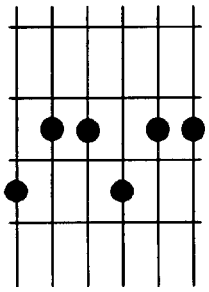
Figure 6H:
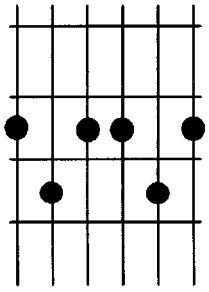
Figure 6I:
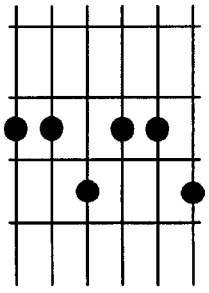
Figure 7A:
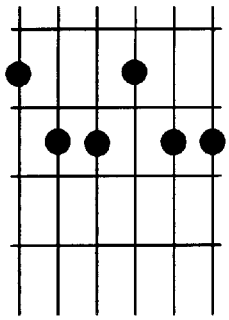
FIGS. 7*a* to 7*i* are diagrams showing chords achievable with the device of FIG. 5 with a second tuning of the guitar.
Figure 7B:
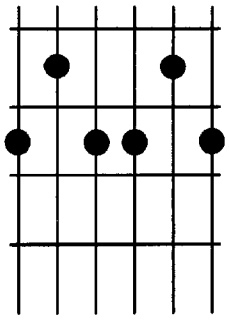
Figure 7C:
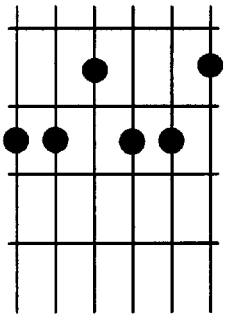
Figure 7D:
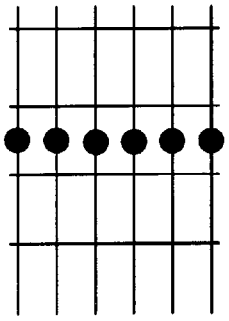
Figure 7E:
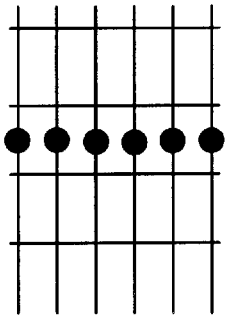
Figure 7F:
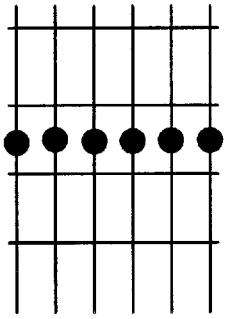
Figure 7G:
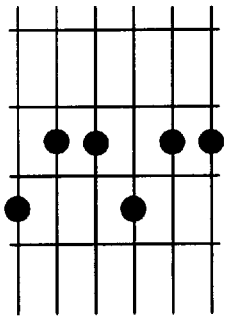
Figure 7H:
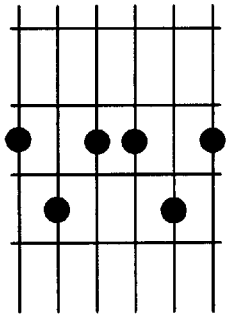
Figure 7I:
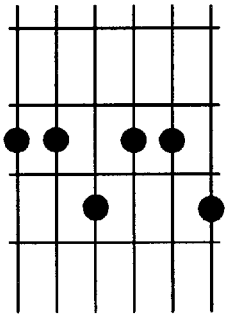
Figure 8:
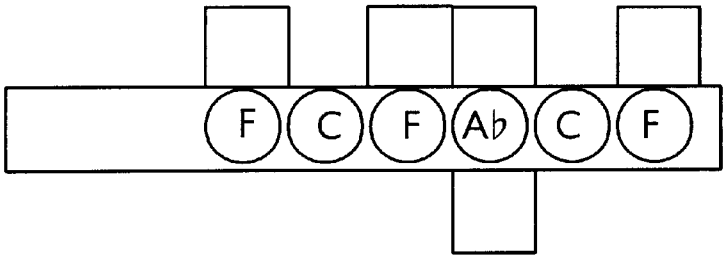
FIG. 8 shows a diagrammatic plan view of a device having a second arrangement of projections.

In the device illustrated in FIG. 5, the forward and rearward nodules act on the same strings, and are separated from each other laterally by two strings between them. Using an opening tuning which spans the octave proportionally—E♭ G B E♭ G B—one can generate seven chords—major chords using the grooves and minor chords using the nodules. At the full bar position, an augmented $5^{th}$ chord is produced, made up of two major $3^{rd}$ intervals. These are illustrated in FIGS. 6*a* to 6*b*.

EXAMPLE 2

The alternative opening tuning uses a root position minor chord—E♭ G♭ B♭ E♭ G♭ B♭—and gives seven very different chords using the same device, as illustrated in FIGS. 7*a* to 7*i*.

EXAMPLE 3

Figure 9A:
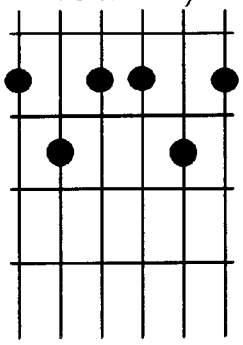
FIGS 9*a* to 9*f* are diagrams showing chords achievable with the device of FIG. 8.
Figure 9B:
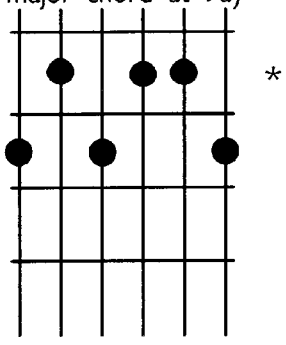
Figure 9C:
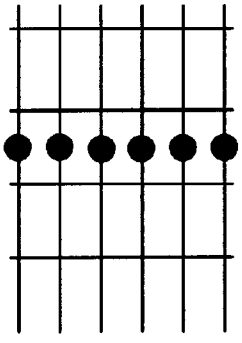
Figure 9D:
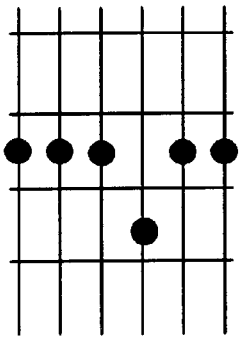
Figure 9E:
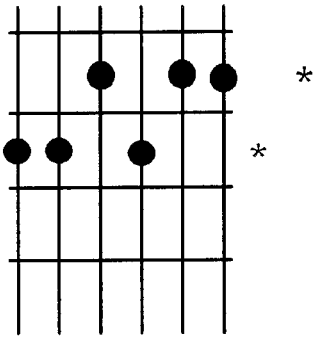
Figure 9F:
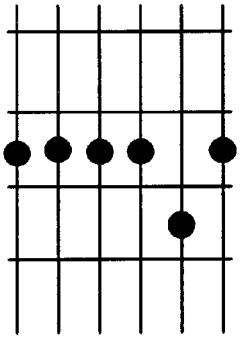

This uses an opening tuning of a very well spread minor chord similar to the standard guitar tuning. The strings are tuned to E♭ B♭ E♭ G♭ B♭ E♭, and the device used (illustrated in FIG.8) has rearward grooves which do not mirror the position of the forward nodules. The grooves are not always all in use, and where one is not in use on the strings, its position is represented in the relevant one (FIG. 9*b*) of FIGS. 9*a* to 9*d* by an asterisk. Further chords may be obtained if some of the strings are not played. Two examples are shown in FIGS. 9*e* and 9*f*, the rectangle indicating the strings which are in use and are to be strummed. The asterisk in FIG. 9*e* represent where a groove and the corresponding full bar position in front of it are not in use, and thus complete the shape of the chord generator map.

EXAMPLE 4

Adding an extra groove and an extra nodule as shown in FIG. 10 allows the chords shown in FIGS. 9*e* and 9*f* to be played using all six strings. The resultant device is noticeably longer than the other devices hereinbefore described, all of which are longer than the width of the widest section of the fingerboard. The full chords resulting are illustrated in FIGS. 11*a* and 11*b*. The grooves are not always in use, and where one is not in use on the strings, its position is shown in the relevant one of FIGS. 11*a* or 11*b* by an asterisk, as is any missing full bar position which occurs before it, as described hereinbefore in Example 5.

EXAMPLE 5

Another possibility for development of the device is to arrange for it to be usable in two alternative orientations achievable simply by rotating the device through 180° in a horizontal plane. To permit this, the forward nodules must also be provided with recesses between them and the barre position on the device. It will be seen that these recesses will have no effect until the device is rotated, and the forward nodules become the rearward nodules, and vice versa. By rotating the device of FIG. 10 through 180°, the configuration shown in FIG. 12 is attained. Alternatively, the device may be arranged to be invertable to give further alternative positions. The device will therefore be provided with grooves on the top (where the fingers normally hold it) so that when it is used upside down the rearward nodules can also be used. Further grooves and nodules may also be added to the top of the device to expand the useful chord options further, as illustrated in FIG. 13. The two added nodules, with or without grooves, are shown with an asterisk inside. Thus, the chord generator now has the potential to be used in four different positions:

Bottom on the fretboard

Bottom on the fretboard, rotated through 180°

Top on fretboard

Top on fretboard, rotated through 180°

It will be understood that what is provided in the top of the chord generator can be different to what is provided on the bottom of the generator. There may be more nodules than grooves to give a better chord choice when the chord generator is used rotated. Grooves may be cut behind some or all of the forward nodules to give a better choice of chords rearwardly when the chord generator is used rotated. The arrangement on each side may be different and the top and bottom configurations may be different.

EXAMPLE 6

In this example, an open tuning of a diminished VIIth chord is used. The strings are tuned to E♭ G♭ A C E♭ G♭. The device as shown in FIG. 14 is used, where the grooves and nodules have four horizontal positions each and may be used on six strings to produce a family of 9 full chords at each fret position. Where a groove or nodule is not in use, its position in FIG. 15 by an asterisk. FIGS. 15*a* to 15*l* illustrate the chords achievable.

It should be further noted that for a bass guitar tuned E G B♭ D♭, a generator device with three bars and rearward grooves could play all twelve notes from one position, one at a time, i.e. at the G fret:

| | | | |
|---|---|---|---|
| G♭ | A | C | E♭ |
| G | B♭ | D♭ | E |
| G♯ | B | D | F. |

Figure 16:
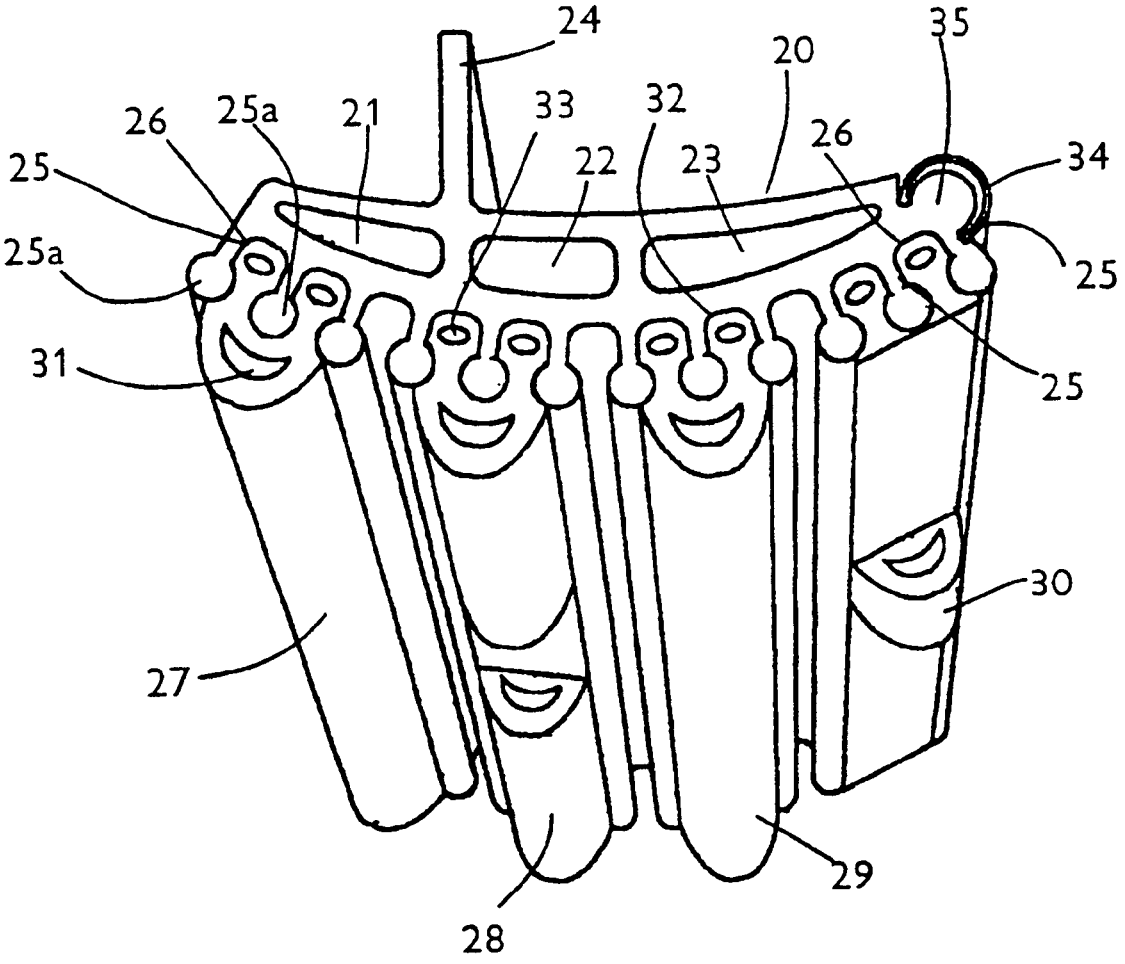
FIG. 16 is a perspective view from below and to one side of yet another embodiment.

FIG. 16 shows a version of the device constructed in modular form suitable for mass production. The device comprises a body portion 20 formed as a portion of an extruded aluminum section with voids 21, 22 and 23 therein to save material and weight, and with a handle 24 upstanding from its upper face.

The underside of the body portion 20 is generally arcuate in section, with a series of rigs 25 extending along it, the ribs 25 in each pair having a curved channel 26 between them. Each rib 25 has, in cross-section, a generally circular head portion 25*a*. A plurality of contact members 27, 28, 29 and 30 are fitted on to the underside of the body portion. One contact member 29 serves as a full width barre approximately centrally, while another contact member 27 serves as a second, rearmost, barre. The remaining contact members 28 and 30 are not full width, but are cut away to provide for the pressing of selected strings as the device is rocked backwards and forwards about the central barre 29. In the case of contact member 28, a slot is cut corresponding to the position of at least one string, while on contact member 30, all but a short length is cut away so as selectively to depress only one string when the device is rotated forward.

The contact members 27–30 are extruded from an elastomeric material. The extrusion is provided with a main internal void 31 to improve the resilience of the lowermost surface thereof so as to mould to the shape of the fingerboard or neck of the instrument, in use, and has a formation 32 along its upper face to receive one of the ribs 25 and to fit into the channels 26 on either side thereof. Voids 33 in the formation 32 improve the compressibility and so assist in fitting the members 27–30 into the channels 26 and holding them in the desired position laterally.

As will be seen from FIG. 16, the extrusion may be cut to any desired configuration to press on one or more strings, and other configurations than those illustrated may be adopted, for example for use with different tunings. The contact members may be positioned on any of the ribs 25 according to the spacing of the frets on the stringed instrument on which it is to be used or, more relevantly, especially where the fingerboard is fretted, according to the portion along the fingerboard.

Because the position of the remaining part of the contact members 30 beneath the body portion cannot readily be seen by the user, a marker strip 34 can be slid on to a shaped formation 35 along one side of the body portion 20 to a longitudinal position corresponding to the portion of the contact member 30.

It will be appreciated that the handle could alternatively be formed as a separate plastics moulding to be slid into a groove in the upper face of the body portion 20. The contact members 27–30 can be formed with different lower profiles, and of materials of different hardness, according to the instrument on which they are to be used.

The device may be made wider than the width of the fingerboard, to allow for lateral movement to provide different chord formations.

FIGS. 17 and 18 illustrate a simplified version of the device shown in FIG. 16. The body portion 40 is formed as a portion of an extended aluminum section with a generally arcuate cross-section having on the convex side six channels 41 defined between seven ribs 42, each having an enlarged head portion 43. A plurality of contact members 44, 45, 46 and 47 are fitted on to the underside of the body portion 40. Two contact members 44 and 47 serve as full width barres while the central members 45 and 46 are spaced apart across the width of the device so as to leave at least one string free when the members 45 and 46 are pressed on to the strings in the neck of a guitar.

The contact members 44–47 are generally similar to these described with reference to FIG. 16 and will therefore not be described here further.

The upper side of the device, as may be seen from FIG. 18, is provided with a compressible pad 48, for example of expanded elastomeric material, for comfort in use, and a loop of cord or elastic material 49 is provided, into which the user's middle finger may be inserted to assist in holding the device. It may also be shaped to conform with the shape of fingers grasping the device.

The device shown in FIGS. 19 and 20 is a variant on that shown in FIGS. 17 and 18. The body portion 50 is formed as a portion of an extended aluminum section with a generally arcuate cross-section having on the convex side seven channels 51 defined between eight ribs 52, each having an enlarged head portion 53. The contact members 54–57 are each formed a section of an extruded elastomeric tube having opposed sides indented to form grooves 58 which conform with the shapes of the head portions 53. Each contact member slides into one of the channels 51.

The upper side of the device, as may be seen from FIG. 20, is provided with a T-shaped compressible pad 59, for example of expanded elastomeric material, for comfort in use and a loop of cord or elastic material 49, as in the embodiment illustrated in FIGS. 17 and 18.

What is claimed is:

1. A device for forming chords on stringed musical instruments of the type having a fingerboard, the device, comprising first means (1, 10, 28, 45, 55) for pressing a plurality of strings on to the fingerboard at a chosen position along the fingerboard, and second means (2, 3, 14, 47, 57) forward of the first means for engaging at least one string, characterised by third means (4, 5, 11, 44, 54) rearward of the first means for pressing at least one string against the fingerboard, whereby the device may be rocked in one direction about said first means such that the second means can raise the pitch of at least one string and in the other direction about the first means such that the third means can engage at least one string so that the pitch of said string is lower relative to the pitch achievable by pressing said string at the chosen position.

2. A device according to claim 1, wherein the pitch is raised or lowered by at least one semitone.

3. A device according to claim 1, comprising a bar for pressing a plurality of strings on to the fingerboard at the chosen position, means projecting forward of the bar for pressing at least one string ahead of the bar when the device is rocked about the bar, means projecting rearwardly of the bar for pressing at least one string behind the bar when the device is rocked in the opposite direction about the bar, and at least one groove rearwardly of the bar such that, as the bar is rocked, a respective string is released from the bar.

4. A device according to claim 3, wherein the means projecting rearwardly comprises a further rearmost bar which depresses all the strings behind the bar.

5. A device according to any preceding claim, comprising a hollow section into which, in use, at least one player's fingers may be inserted.

6. A device according to claim 5, which is generally conical along its length.

7. A device according to claim 5, comprising a flexible resilient material inside its hollow section.

8. A device according to claim 7, formed of a plastics material.

9. A device according to claim 8, at least partly formed of a transparent plastics material.

10. A device according to claim 1, wherein the means for pressing the strings are provided with a surface of an elastomeric material.

11. A device according to claim 1, comprising a body portion to which separate components, for pressing strings or providing grooves for the passage of strings, may be removably attached.

12. A device according to claim 11, wherein the separate components are a sliding fit into grooves provided on the underside of the body portion.

13. A device according to claim 12, wherein the separate components are formed of resiliently compressible materials.

14. A device according to claim 13, wherein the separate components are formed with voids therein to increase compressibility.

15. A device according to claim 11, wherein the separate components are formed by extrusion.

16. A device according to claim 5, comprising a flexible resilient material on the topmost outer surface of the device.

* * * * *